United States Patent [19]

Schiel

[11] Patent Number: 4,880,501

[45] Date of Patent: Nov. 14, 1989

[54] PRESS COVER FOR A PRESS FOR DEWATERING WEB MATERIAL

[75] Inventor: Christian Schiel, Heidenheim, Fed. Rep. of Germany

[73] Assignee: J.M. Voith GmbH, Fed. Rep. of Germany

[21] Appl. No.: 230,568

[22] Filed: Aug. 10, 1988

[30] Foreign Application Priority Data

Aug. 19, 1987 [DE] Fed. Rep. of Germany ..... 3727563

[51] Int. Cl.[4] ..... B30B 9/20

[52] U.S. Cl. ..... 162/358; 162/373; 29/132; 100/121; 100/155 R; 100/176

[58] Field of Search ..... 162/358, 373; 29/132; 100/121, 155, 176

[56] References Cited

U.S. PATENT DOCUMENTS 4,353,296 10/1982 Beucker ..... 100/121
4,561,939 12/1985 Justus ..... 162/358 X

FOREIGN PATENT DOCUMENTS 1080068 4/1960 Fed. Rep. of Germany ..... 100/121
2814682 10/1981 Fed. Rep. of Germany .
WO87/02080 4/1987 PCT Int'l Appl. .

*Primary Examiner*—Kenneth M. Schor
*Assistant Examiner*—Thi Dang
*Attorney, Agent, or Firm*—Ostrolenk, Faber, Gerb & Soffen

[57] ABSTRACT

An elastically deformable press cover of a press for dewatering web material, in particular of a dewatering press for paper making machines, or the like. The press cover surrounds a support and is an endless belt. At its outside, which faces toward the web, the press cover has ridges which lie in preferably equidistant diametral planes or run round the cover in the form of a helical line. Between the ridges there remain grooves which are open to the outside. As seen in cross-section, the top lands of the ridges are concave.

15 Claims, 2 Drawing Sheets

PRESS COVER FOR A PRESS FOR DEWATERING WEB MATERIAL

BACKGROUND OF THE INVENTION

The present invention relates to an elastically deformable press cover of a press for dewatering a web material, in particular a press cover of a dewatering press for a paper making machine, or the like. The press cover has ridges on its outside, which faces the web, and between the ridges where there remain grooves which are open to the outside.

Press covers of this kind for dewatering presses are used, for example, in the press section of a paper making machine, for pressing water out of a wet paper web and conducting the water away. In such an arrangement, the paper web is passed through a press zone, together with a dewatering felt, or is alternatively sandwiched between two dewatering felts. The press zone can be formed from two rotatable press rolls which meet at a nip. At least one of the press rolls has an elastically deformable press cover which is provided with grooves on its exterior. The press zone can alternatively be formed by a single rotatable press roll which cooperates with and presses against a pressure shoe. The pressure shoe presses a press cover against the press roll so that the press roll co-revolves with the press cover. This arrangement forms an extended press zone, which is extended in the direction of web running. In either case, water is squeezed out of the paper web in the press zone and is released directly to at least one dewatering felt that is moving through the press zone along with the web. Part of the water from the web passes through the pores of the felt and into the above mentioned grooves in the press cover.

Grooves of this kind are provided in press rolls particularly for relatively high paper web running speeds, i.e. relatively high production speeds. Grooved press rolls are known in which the grooves are worked into a metallic press roll cover. In these press rolls, the cross-sectional shapes of the ridges and the grooves remain unchanged in the press zone. However, the specific compression in the press zone is relatively high, creating a danger that the paper web will be crushed. In contrast, when an elastic press cover is used, the specific compression remains at an acceptable magnitude, even at a relatively high linear force. However, the ridges between the grooves are spherically deformed or rounded in the press zone, and the grooves are at the same time narrowed due to the deformation of the ridges. This has the disadvantage that the water space capacity of the grooves is reduced and the flow off of water through the grooves is hindered.

The present invention is concerned with an elastic press cover. A press cover of this kind can be applied as a fixed covering on a rotatable roll element. See U.S. Pat. No. 4,353,296 and German Pat. No. 2,814,682. Alternatively, the press cover can be designed as an endless, flexible belt or as a tube. The outside of the belt or tube is pressed against a mating press roll by means of a pressure shoe or by means of a rotating roll element behind or inside the press cover. See German Offenlegungsschrift No. 3,501,635, which is equivalent to U.S. Pat. No. 4,625,376, and see U.S. Pat. Nos. 4,552,620 and 4,238,287.

With known elastic press covers, measures have been proposed for avoiding the narrowing of the grooves in the press zone. FIG. 2*a* of U.S. Pat. No. 4,353,296 suggests that the deformation of the ridges be avoided or at least reduced by using materials for the cover having anisotropic properties. Thus, the modulus of elasticity measured transverse to the direction of running is said to be greater than the modulus of elasticity measured in the direction of running. However, it is doubtful whether this proposal avoids ridge deformation and whether it can be implemented with a reasonable input of manufacturing expenditure.

German Pat. No. 2,814,682 describes a press roll having a grooved, elastic cover, in which the grooves are widened at their bases. However, the ridges are thereby correspondingly weakened considerably at their "foot". There is a risk that the ridges will bend over under load so that the dewatering felt will thereby be damaged and/or the paper web will no longer be compressed with sufficient uniformity over its width.

A further attempt to solve the problem mentioned is described in International Application No. WO87/02080 with reference to an elastic press belt for a pressure shoe press. According to FIG. 2, the press belt comprises an elastomeric layer of material with a reinforcing fabric embedded in it. FIG. 3 suggests how the ridges are deformed in the press zone and how the grooves are narrowed. To avoid this, it is proposed that the two sides of the elastomeric layer of material be formed of different materials. In other words, the reinforcing fabric is to be coated with different types of plastic on each of its two sides. It is intended that the inside of the press belt which slides over the pressure shoe be less hard than the outside into which the grooves have been worked. However, production of this kind of belt is very expensive because the coating of the reinforcing fabric must take place in two separate operations and the press belt must be turned over in the interim. Furthermore, there is the danger that the two different elastomeric layers will come apart over time.

As is explained below, an attempt has already been made to increase the water holding capacity of the grooves in the press zone, despite the deformation of the ridges, by making the grooves wider. However, as a result, the grooves could be seen in the finished paper, i.e. so called groove marking is produced in an undesirable fashion in the paper (see U.S. Pat. No. 4,353,296, column 1, lines 32–37).

SUMMARY OF THE INVENTION

The object of the invention is to provide an elastically deformable press cover which has grooves on its outside in a manner such that the grooves have a high water space capacity in the press zone and such that groove marking is nevertheless avoided in the finished paper. The press cover should furthermore be producible with minimum effort.

This object is achieved by forming the top lands of the ridges on the outside of the press cover of concave design, as viewed in cross-section, so that the edges of the lands are taller and the central region between the edges is depressed. When the elastic press cover according to the invention, together with the elastic dewatering felt and with the paper web, is subjected to pressure in the press nip in the press zone, the ridges are deformed such that their originally concave top lands become flat, as seen in a cross-section. The felt is largely or perhaps completely uniformly compressed over the entire width of each ridge. The invention enables the grooves opening on the outside of the press cover to be made somewhat wider than previously, in order to achieve a high water holding capacity in spite of the ridge deformation, while nevertheless avoiding the risk of groove marking in the finished paper. This is because the resultant, more uniform compression of the dewatering felt results in a considerably more uniform compression and dewatering of the paper web across width.

Preferred dimensions of the grooves and ridges are given below.

The press cover according to the invention can be designed, like the known press covers mentioned above, as a fixed roll covering fixed over a rotating press roll or as a tube or belt which runs around loosely over a stationary press shoe. In the latter case, the press cover according to the invention has the advantage, as compared with that in WO 87/02080, that it is possible to avoid using different materials and degrees of hardness on the outside and inside of the elastomeric layer of material. The invention makes it possible to use a single material for both sides of the press cover. In the production of a press cover of this kind, it is possible and preferable to use the method described in German Patent Application No. P 37 15 153.3.

Other objects and features of the present invention will become apparent from the following description of a preferred embodiment of the invention considered in conjunction with the accompanying drawings.

DETAILED DESCRIPTION OF THE PRIOR ART

Figure 1:
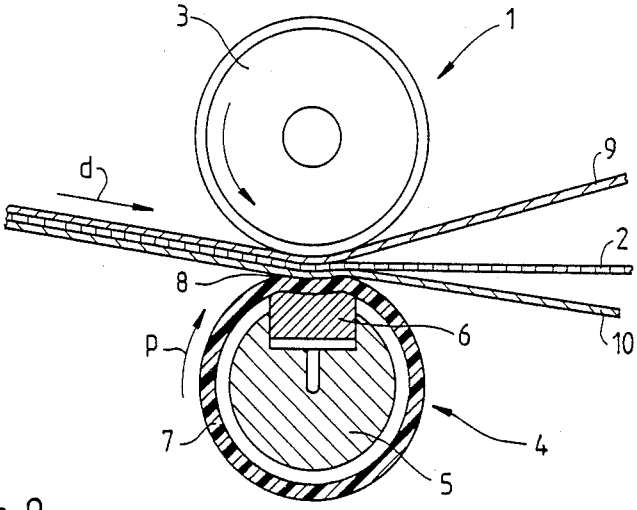
FIG. 1 is a side view of a press for dewatering a paper web and having a press cover that is guided over a pressure shoe.

In FIG. 1, a press 1 for dewatering a moving paper web 2 is illustrated diagrammatically, without showing a frame for the press. The press 1 essentially comprises a top roll 3 and a bottom roll 4. The roll 4 has a fixed core, or yoke or beam 5 which supports a pressure shoe 6 that is pressed hydraulically against the top roll 3 and in which core the shoe is guided. The fixed core 5 and the hydraulically mounted pressure shoe 6 of the bottom roll 4 are surrounded by an endless, tubular, elastic press cover 7, which is comprised of an elastomeric material having embedded reinforcing threads.

The press cover 7 has a smooth inside surface that slides over the wide outside or top surface of the pressure shoe 6. Together with the top roll 3, the shoe 6 forms an extended press zone 8 to define a long nip press. The concave outside of the pressure shoe 6 is generally matched to the diameter of the top roll 3.

To reduce the friction between the pressure shoe 6 and the press cover 7, a device, not shown, wets the inner side of the press cover 7 with lubricant.

The paper web 2 is fed (arrow d) between two dewatering fabric webs, i.e. felts 9, 10, in the press zone 8. The friction between the lower dewatering felt 10 and the press cover 7 moves the cover over the pressure shoe 6 and the belt rotates in the direction of arrow p. In the press zone 8, the outside of the press cover 7, which as shown in FIGS. 2 to 9 is provided with grooves, takes up water from the lower dewatering felt 10, which water had been removed from the paper web 2. The water is temporarily stored in the grooves and is removed from the grooves outside the press zone 8.

In this arrangement, the grooves are provided across the entire width of the press 1 in equidistant diametral planes through the press cover 7. The grooves can also extend across the entire width of the press cover 7 in the form of a helical line.

The cross-section of the grooves is generally rectangular. This rectangle is dimensioned such that the ratio between the depth of a groove and the width of that groove is preferably between 4:1 and 5:1.

Figure 2:
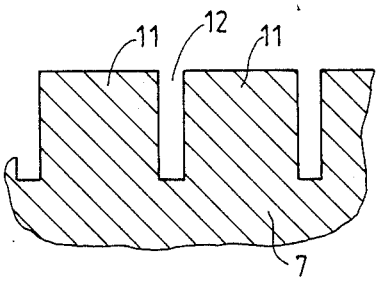
Fig.2 PRIOR ART
FIG. 2 is a cross-section, parallel to the press roll axis, at the outside of a press cover having dewatering grooves in accordance with the prior art.

FIG. 2 shows a detail of a cross-section, parallel to the axis, through the outside of the conventional press cover 7, in the condition without loading by the pressing pressure. The outside of the press cover has a uniform sequence of ridges 11 and grooves 12. All of the grooves have the same sizes and shapes, as do all of the ridges. The top lands or outer surfaces of the ridges 11 together define the cylindrical shape of the press cover 7. The top lands are flat, as seen in cross-section. In the press zone 8 in FIG. 1, the grooves 12 form a storage volume for part of the water which has been pressed out of the paper web and has passed into the grooves via the dewatering felt 10.

Figure 3:
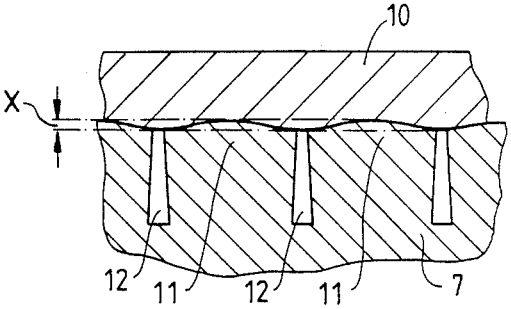
Fig.3 PRIOR ART
FIG. 3 is the cross-section of FIG. 2 showing the press cover under load from the pressing pressure.

FIG. 3 shows a detail of FIG. 2 along with the dewatering felt 10. In the press zone 8, the felt 10 rests against the outside of the press cover 7, i.e. against the ridges 11. The press cover 7 and the felt 10 are there being subjected to the pressing pressure. This deforms the elastic material of the press cover 7 such that, principally, the top lands of the ridges 11 are spherically deformed or rounded, and the grooves 12 simultaneously become narrower at their open ends. The "spherical deformation" of the top lands of the ridges 11 means that the top lands, as viewed in cross-section, take on a convex shape. The dewatering felt 10, which is likewise compressed, lies matingly on the convexly shaped top lands, i.e. the felt is more highly compressed in the middle of each ridge than at the two side edges. As the grooves 12 narrow toward the outside of the press cover, the grooves take on an approximate equilateral trapezium cross-sectional shape. This narrowing of the grooves 12 is generally so great that the grooves can only take up a relatively small quantity of water.

Figure 4:
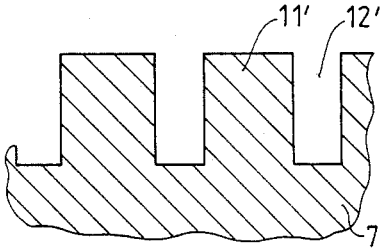
Fig.4 PRIOR ART
FIG. 4 is a cross-section like FIG. 2 wherein the press cover has widened dewatering grooves, as compared with the grooves in FIG. 2, and also in accordance with the prior art.
Figure 5:
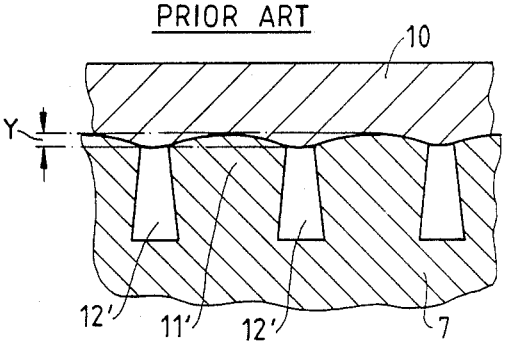
Fig.5 PRIOR ART
FIG. 5 shows the cross-section according to FIG. 4 with the press cover under load from the pressing pressure.

Another conventional modification of the press cover 7 is shown in FIGS. 4 and 5. Here the groves 12' are designed wider than the grooves 12 in FIG. 2, i.e. the ridges are more widely spaced. The narrowing of the grooves, as a consequence of the pressing pressure, relative to the groove width is thus less in FIG. 5 than in FIG. 3. As a result, the water holding capacity of the grooves 12' and of the flow off cross-section for the water are adequate. A still further widening of the grooves 12, while retaining the same groove spacing, makes the ridges 11' narrower than the ridges 11. This is not useful in view of the decreasing resistance of the narrower ridges to tilting which this causes.

According to FIG. 5, the ridges 11' are in principle deformed in exactly the same manner as the ridges 11 in FIG. 3. One disadvantage of the greater width of the grooves is that the dewatering felt 10 not only lies against the convexly shaped top lands but it also is partially pressed into the grooves 12', and much more so than in FIG. 3. In addition, the elastic felt 10 is more highly compressed, even more than in FIG. 3, in the middle of the ridge than at the edges. It has been recognized that this is the reason for the undesired groove marking, mentioned above, in the finished paper. It can also be seen that previous conceptions, in FIG. 2*a* of U.S. Pat. No. 4,353,296 and FIG. 3 of WO87/02080, of the nature of the deformation of the ridge are apparently incorrect since they do not take into account that the felt, which is pressed against wise elastically deformable. In any event, in FIG. 5, the uniformity of the compression, and thus of the dewatering of the paper web, over the width of the machine is reduced so much that the quality of the paper no longer meets its requirements.

DESCRIPTION OF THE PREFERRED EMBODIMENT

Figure 6:
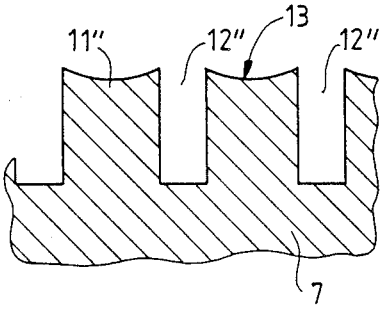
FIG. 6 is a cross-section, parallel to the axis, at the outside of a press cover having ridges according to the invention.

FIG. 6 illustrates a detail of a press cover 7 in accordance with the present invention. The press cover has approximately the same wider groove width and the same groove spacing as in FIGS. 4 and 5. The ridges 11" are now concavely curved at their top lands 13, as seen in cross-section.

Figure 7:
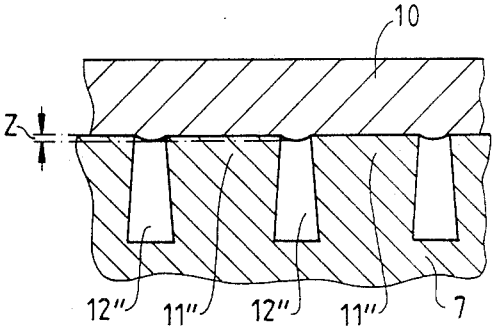
FIG. 7 is the cross-section according to FIG. 6 with the press cover under load from the pressing pressure.

As illustrated in FIG. 7, when the dewatering felt 10 together with the paper web and the press cover 7 now run through the press zone 8 (FIG. 1), the more elevated edge regions of the concave top lands 13 of the ridges 11" are pressed flat. The sides of the grooves 12" are at the same time pressed inward, so that the grooves 12" again have essentially the cross-sectional shape of an equilateral trapezium.

From FIG. 7, it can be seen that the boundary between the dewatering felt 10 and the ridges 11" under pressure now stretches in a straight line across the width of the press cover 7. Of course, the dewatering felt 10 is still partially pressed into the grooves 12", even in the arrangement of FIG. 7. In a comparison among FIGS. 3, 5 and 7, it can easily be seen that the deformations of the dewatering felt 10 are the least in the embodiment of the invention in FIG. 7. This is seen in the maximum deviations between the geometric points represented by the middle of the ridge and the middle of the groove in comparing x in FIG. 3, y in FIG. 5 and z in FIG. 7. The embodiment of FIG. 7 also provides substantially uniform compression of the paper web across its width. At the same time, a relatively large water holding capacity of the grooves 12" has been achieved. Finally, the dewatering felt 10 may also be expected to suffer less wear.

It is possible to conceive of the specific concave geometry of each top land 13 of a ridge 11" as an arcuate, V-shaped or even polygon-like recess or notch. The most advantageous shape, as well as the most advantageous dimensions depend on the particular press cover material used and on the particular type of dewatering felt.

Figure 8:
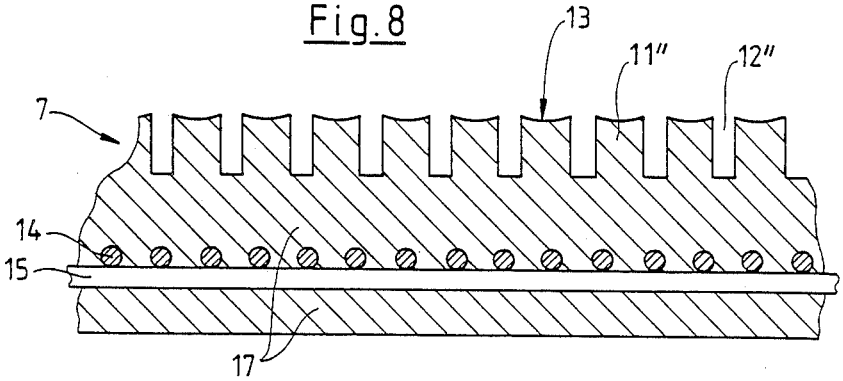
FIG. 8 is a section through a press cover of the invention, the section extending across the width of a paper making machine and parallel to the axis.

FIG. 8 shows a detail of a tubular or endless belt press cover 7 having a plurality of ridges 11" and grooves 12" of uniform size, shape and spacing in sequence. The ridges 11" and grooves 12" run in the circumferential direction or they run helically across the entire press cover. The top lands 13 of the ridges 11" are again concave, as seen in cross-section.

In the region between the outside of the press cover, which is provided with the grooves 12', and the smooth inside of the press cover, which slides over the pressure shoe 6 in FIG. 1, the press cover 7 shown in FIG. 8 has high strength reinforcing threads, e.g. longitudinal threads 14 and circumferential threads 15, whose elasticity is less than that of the elastomeric press cover material 17. According to German Patent Application No. P 3,715,153, the elastomeric layer 17, at least that part of the layer 17 which surrounds the reinforcing threads 14, 15 on all sides, is preferably produced from a single casting, i.e. in a single casting operation. The circumferential threads 14 are wound into the still liquid cover material 17 during the casting operation.

Figure 9:
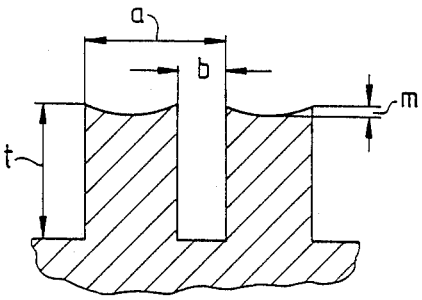
FIG. 9 is a partial section according to FIG. 6 but with arrow heads.

Preferred dimensions for the grooves and the ridges are provided below, with reference to FIG. 9.

The spacing of the grooves with respect to one another (dimension a) is preferably in the range between 2.5 and 3.5 mm. The width of the groove in the non-loaded condition (dimension b) is then preferably in the range between 0.7 and 1.2 mm, in combination with a depth (dimension t) which is preferably in the range between 0.8 and 1.0 times the groove spacing (dimension a).

The depth of the concave recesses (dimension m) provided on the top lands of the ridges, is preferably in the range between 0.02 and 0.4 mm, and the particular recess depth m should be matched to the material of the press cover and to the pressing force in the press nip.

In certain circumstances, it is conceivable for the reduction in the recess depth m, which results over time during operation due to wear at the edges of the recess, to be compensated by reducing the linear force in the press nip as the length of time of operation of the press cover increases, i.e. as the wear increases. It is thereby possible initially to select a relatively large recess depth m for a new press cover, i.e. in the region of 0.4 mm, as mentioned.

Although the present invention has been described in connection with a preferred embodiment thereof, many other variations and modifications will now become apparent to those skilled in the art. It is preferred, therefore, that the present invention be limited not by the specific disclosure herein, but only by the appended claims.

What is claimed is:

1. An elastically deformable press cover for a press for dewatering a web material, the press cover having:

an outside for facing toward the web material, the outside of the cover having ridges defined on it, the ridges being spaced apart by grooves defined in the cover, and the grooves being defined by and between the ridges and facing the outside of the press cover;

the ridges having top ends toward the outside of the cover and having top lands at their top ends; and each ridge top land having opposite edges and being concavely shaped between the opposite edges thereof.

2. The press cover of claim 1, wherein the top lands have upraised edges, and the grooves are wide enough and the ridges are of such a height and width that dewatering pressure to be applied to the concave lands will depress the upraised edges of the top lands and will generally flatten the concavity of the top lands, which will press the top lands wider and outwardly but will not block access into the grooves.

3. The press cover of claim 2, wherein the ridges are in the form of circular rings extending around the press cover.

4. The press cover of claim 2, wherein the ridges are in the form of a helical line extending around the press cover.

5. The press cover of claim 2, wherein the cover is in the form of an endless belt being wrapped around a pressure applying means for applying pressure thereto, and the belt outside being on the side of the belt facing away from the pressure applying means, the ridges and the grooves extending around the endless belt.

6. The press cover of claim 5, wherein the ridges extend around the outside of the cover in substantially equidistant diametral planes.

7. The press cover of claim 6, wherein the width of the grooves is in the range of about 0.7 mm 1.2 mm.

8. The press cover of claim 7, wherein the each concave land, as seen in cross-section, is deeper in the middle of the land than at the two upraised edges thereof and the depth of the middle is in the range of 0.02 mm to 0.4 mm.

9. The press cover of claim 6, wherein the each concave land, as seen in cross-section, is deeper in the middle of the land than at the two upraised edges thereof and the depth of the middle is in the range of 0.02 mm to 0.4 mm.

10. In combination, the press cover of claim 5, with a web of material to be dewatered disposed above the outside of the press cover and with a web of a dewatering fabric material disposed between the web to be dewatered and the press cover; the dewatering fabric web being generally a flat surface web on the side thereof toward the press cover;

means for applying pressure against the web to be dewatered for pressing the web to be dewatered and the fabric web toward the press cover; and press cover support means for pressing against the inside of the press cover and opposing the pressure applied thereto by the pressure applying means.

11. The combination of claim 10, further comprising an additional dewatering fabric web disposed on the side of the web to be dewatered which is not facing the first mentioned dewatering fabric web so as to be pressed against the web to be dewatered by the pressure applying means.

12. The press cover of claim 2, which comprises a layer of elastomeric material and comprises reinforcing threads embedded in the layer of elastomeric material.

13. The press cover of claim 12, wherein the entire layer of elastomeric material, including the outside thereof which is provided with the ridges and grooves, comprises uniform elastomeric material with the reinforcing threads embedded.

14. The press cover of claim 2, wherein the width of the grooves is in the range of about 0.7 mm 1.2 mm.

15. The press cover of claim 2, wherein the each concave land, as seen in cross-section, is deeper in the middle of the land than at the two upraised edges thereof in the range of 0.02 mm to 0.4 mm.

* * * * *